US005691002A

United States Patent [19]

Oda et al.

[11] Patent Number: 5,691,002

[45] Date of Patent: Nov. 25, 1997

[54] COATING METHOD

[75] Inventors: Hiroaki Oda, Hiratsuka; Masaru Mitsuji, Zama; Yasumasa Okumura, Yokohama; Hiroshi Inoue; Hisashi Isaka, both of Hiratsuka, all of Japan

[73] Assignee: Kansai Paint Company, Limited., Amagasaki, Japan

[21] Appl. No.: 596,094

[22] PCT Filed: Jun. 1, 1995

[86] PCT No.: PCT/JP95/01079

§ 371 Date: Jan. 31, 1996

§ 102(e) Date: Jan. 31, 1996

[87] PCT Pub. No.: WO95/33578

PCT Pub. Date: Dec. 14, 1995

[30] Foreign Application Priority Data

Jun. 3, 1994 [JP] Japan ..... 6-145696

[51] Int. Cl.[6] ..... B05D 1/36

[52] U.S. Cl. ..... 427/407.1

[58] Field of Search ..... 427/407.1, 409

[56] References Cited

U.S. PATENT DOCUMENTS

| | | | |
|---|---|---|---|
| 4,444,960 | 4/1984 | Salee et al. | 525/534 |
| 4,728,545 | 3/1988 | Kurauchi et al. | 427/407.1 |
| 4,889,793 | 12/1989 | Taniguch et al. | 430/284.1 |
| 4,916,020 | 4/1990 | Golding et al. | 428/421 |
| 5,266,361 | 11/1993 | Schwarte et al. | 427/407.1 |
| 5,334,420 | 8/1994 | Hartung et al. | 427/409 |
| 5,356,670 | 10/1994 | Briggs et al. | 427/409 |
| 5,439,710 | 8/1995 | Vogt et al. | 427/407.1 |
| 5,510,148 | 4/1996 | Taljan et al. | 427/409 |
| 5,538,076 | 7/1996 | Mizuno et al. | 427/409 |
| 5,601,880 | 2/1997 | Schwarte et al. | 427/409 |

*Primary Examiner*—Diana Dudash

*Attorney, Agent, or Firm*—Armstrong, Westerman, Hattori, McLeland & Naughton

[57] ABSTRACT

The coating method of the present invention comprises sequentially applying an amine-neutralized type aqueous intermediate coating composition and an amine-neutralized type aqueous top coating composition, the method being characterized in that a coating composition mainly comprising (A) an amine-neutralized base resin having a hydroxyl value of 30 to 150 KOH mg/g and an acid value of 15 to 50 KOH mg/g, (B) an amino resin and (C) an organic sulfonic acid amine salt is used as the amine-neutralized type aqueous intermediate coating composition. The method of the present invention can improve the adhesion between layers of a multi-layer coating film formed from aqueous coating compositions and chipping resistance of said coating film.

6 Claims, No Drawings

COATING METHOD

TECHNICAL FIELD

The present invention relates to a coating method, and an object of the invention is to improve the adhesion between layers of a multi-layer coating film formed from aqueous coating compositions and the chipping resistance of said coating film.

BACKGROUND ART

A technique is known wherein an automotive exterior panel is finished by sequentially applying a cationic electrophoretic coating composition, an aqueous intermediate coating composition and an aqueous top coating composition. In this coating system, thermosetting aqueous coating compositions mainly comprising (A) an amine-neutralized base resin having a hydroxyl group and a carboxyl group and (B) an amino resin are used as the aqueous intermediate coating composition and aqueous top coating composition. However, there is a problem that the coating film formed from such aqueous coating compositions is not satisfactory in adhesion between layers and chipping resistance.

DISCLOSURE OF INVENTION

An object of the invention is to provide a coating method which can improve the adhesion between layers of a multi-layer coating film formed from aqueous coating compositions.

Another object of the invention is to provide a coating method which can improve the chipping resistance of a coating film formed from aqueous coating compositions.

Other characteristics of the present invention will be apparent from the following description.

The coating method of the present invention comprises sequentially applying an amine-neutralized type aqueous intermediate coating composition and an amine-neutralized type aqueous top coating composition, the method being characterized in that a coating composition mainly comprising (A) an amine-neutralized base resin having a hydroxyl value of 30 to 150 KOH mg/g and an acid value of 15 to 50 KOH mg/g, (B) an amino resin and (C) an organic sulfonic acid amine salt is used as the amine-neutralized type aqueous intermediate coating composition.

The amine-neutralized type aqueous intermediate coating composition for use in the invention mainly comprises (A) a resin prepared by neutralizing, with an amine, a base resin having a hydroxyl value of 30 to 150 KOH mg/g and an acid value of 15 to 50 KOH mg/g, (B) an amino resin and (C) an organic sulfonic acid amine salt, and can be readily prepared by mixing components (A), (B) and (C) with water to disperse the components.

The base resin for use in component (A) is a polyester resin, an acrylic resin, an urethane resin, an alkyd resin or the like which contains a hydroxyl group and a carboxyl group and has a hydroxyl value of 30 to 150 KOH mg/g, preferably 60 to 120 KOH mg/g, and an acid value of 15 to 50 KOH mg/g, preferably 20 to 40 KOH mg/g. If the hydroxyl value of the base resin is less than 30 KOH mg/g, the obtained coating film has a reduced curability, whereas if the hydroxyl value is more than 150 KOH mg/g, the obtained coating film is poor in flexibility, chipping resistance and the like. Thus hydroxyl values outside said range are not preferable. Further, if the acid value of the base resin is less than 15 KOH mg/g, the water-dispersion stability of the intermediate coating composition as such is reduced, whereas an acid value more than 50 KOH mg/g results in a coating film which is poor in water resistance, chemical resistance and the like. Thus, acid values outside said range are not preferable.

In the invention, any of conventionally known resins can be used as the base resin insofar as they have the above characteristic values, and formulation of the starting components of the resin and the molecular weight of the resin are not specifically limited. Suitable number average molecular weight of the base resin for use in the invention is usually about 1000 to 50000, more preferably about 5000 to 30000.

Component (A) for use in the invention is an amine-neutralized base resin prepared by neutralizing, with an amine, a part or the whole of the carboxyl groups in the above-mentioned base resin. A wide variety of conventionally known amines can be used herein. Examples include primary monoamines such as methylamine, ethylamine, n-propylamine, isopropylamine, butylamine, benzylamine, monoethanolamine, neopentanolamine, 2-aminopropanol, 3-aminopropanol, 2-amino-2-methylpropanol and the like; secondary monoamines such as dimethylamine, diethylamine, diisopropylamine, dibutylamine, diethanolamine, di-n-propanolamine, diisopropanolamine, N-methylethanolamine, N-ethylethanolamine, butylethanolamine and the like; tertiary monoamines such as triethanolamine, trimethylamine, triethylamine, triisopropylamine, tributylamine, methyldiethanolamine, ethyldiethanolamine, butyldiethanolamine, dimethylethanolamine and the like; polyamines such as diethylenetriamine, methylaminopropylamine and the like. According to the invention, these amines are used singly or at least two of them are used in mixture. Among these amines, preferred are alkanolamines such as 2-amino-2-methylpropanol, N-methylethanolamine, dimethylethanolamine and the like. The amount of the amine can be suitably selected according to the amount of the carboxyl groups in the base resin to be neutralized.

The neutralization reaction between the base resin and the amine can be carried out by a conventional method at room temperature or with heating.

In the invention, the amino resin as component (B) is used as the crosslinking agent for component (A). Specific examples of the amino resin include melamine resins, urea resins, benzoguanamine resins and hydroxymethylated products of these resins, etherified amino resins obtained by etherifying a part or the whole of said hydroxymethylated products with a monoalcohol having 1 to 8 carbon atoms. Among them, the partially or completely etherified melamine resins are especially preferred. The number average molecular weight of the amino resin is not limited specifically, but is preferably about 300 to 5000, in particular about 500 to 2000.

In the invention, the organic sulfonic acid amine salt for use as component (C) is a compound obtained by reacting an organic sulfonic acid with an amine. A wide variety of conventionally known organic sulfonic acids can be used. Examples are paratoluenesulfonic acid, dodecylbenzenesulfonic acid, dinonylnaphthalenesulfonic acid, dinonylnaphthalenedisulfonic acid, trifluoromethanesulfonic acid and the like. Among them, dodecylbenzenesulfonic acid is especially preferred. As the amine, those used as the neutralizing agent for preparing component (A) can be widely used. The amines can be used singly or at least two of them can be used in mixture. Preferably usable amines are alkanolamines such as 2-amino-2-methylpropanol, N-methylethanolamine, dimethylethanolamine and the like.

The reaction between the organic sulfonic acid and the amine is a neutralization reaction and preferably carried out using the amine in excess.

In the invention, the proportions of the components (A) and (B) are not limited specifically, but preferably are 50 to 90%, in particular 60 to 80% of component (A), and 50 to 10%, in particular 40 to 20% of component (B), based on the total weight of the two components.

The proportion of component (C) is not limited specifically and can be selected from a wide range. However, preferred proportion is 0.1 to 10 parts by weight, in particular 1 to 5 parts by weight, per 100 parts by weight of the total of components (A) and (B).

The amine-neutralized type aqueous intermediate coating composition for use in the invention can be readily prepared by mixing the above components (A), (B) and (C) with water to disperse the components. The proportions of components (A), (B) and (C) and water are not limited specifically, but the components and water are preferably mixed in such proportions that the resulting coating composition has a solid content of 30 to 70% by weight, in particular 40 to 60% by weight, when applied.

In the invention, suitable color pigments, extender pigments, ultraviolet absorbing agents and the like can be further added to the amine-neutralized aqueous intermediate coating composition, when required. The amount of the pigments is preferably 10 to 150 parts by weight per 100 parts by weight of the total of components (A) and (B).

The coating method of the present invention is carried out by applying the amine-neutralized type aqueous intermediate coating composition to a substrate and then applying an amine-neutralized type aqueous top coating composition.

A wide variety of conventionally known amine-neutralized type aqueous top coating compositions can be used, but those preferably usable are as follows.

Preferred amine-neutralized type aqueous top coating composition for use in the invention mainly comprises (D) a resin prepared by neutralizing, with an amine, a base resin having a hydroxyl group and a carboxyl group and (E) an amino resin, and can be readily prepared by mixing components (D) and (E) with water to disperse the components.

The base resin for use as component (D) can be widely selected from conventionally known resins insofar as they have a hydroxyl group and a carboxyl group. Examples include polyester resins, acrylic resins, fluorine resins, silicon-containing resins and the like. The hydroxyl value and acid value of the base resin for use in component (D) are not limited specifically, but the hydroxyl value is preferably 30 to 200 KOH mg/g, in particular 50 to 150 KOH mg/g, and the acid value is preferably 10 to 100 KOH mg/g, in particular 15 to 75 KOH mg/g. The number average molecular weight of the base resin is usually about 1000 to 100000, preferably about 5000 to 50000.

Component (D) for use in the invention is an amine-neutralized base resin obtained by neutralizing a part or the whole of the carboxyl groups in the base resin mentioned above. The amines used for preparing component (A) can be widely usable. The amines can be used singly or at least two of them can be used in mixture. The amount of the amine can be suitably selected according to the amount of the carboxyl groups in the base resin to be neutralized. The neutralization reaction between the base resin and the amine is carried out by a conventional method at room temperature or with heating.

In the invention, the amino resin as component (E) is used as the crosslinking agent for component (D). Specific examples of the amino resin include melamine resins, urea resins, benzoguanamine resins and hydroxymethylated products of these resins. Further, in the invention, etherified amino resins are also usable which are obtained by etherifying a part of the whole of the above hydroxymethylated products with a monoalcohol having 1 to 8 carbon atoms. Particularly preferred in the invention are imino-containing melamine resins obtained by partially hydroxymethylating the amino resin to allow the imino groups (-NH) to remain. The number average molecular weight of the amino resin is not limited specifically, but is preferably about 300 to 5000, in particular about 400 to 2000.

The proportions of components (D) and (E) are not limited specifically, but are preferably 50 to 90%, in particular 60 to 80% of component (D), and 50 to 10%, in particular 40 to 20% of component (E), based on the total weight of the two components.

The amine-neutralized type aqueous top coating composition for use in the invention can be readily prepared by mixing components (D) and (E) with water to disperse the components. The proportions of components (D) and (E) and water are not limited specifically, but the components and water are preferably mixed in such proportions that the resulting coating composition has a solid content of 15 to 60% by weight, when applied.

In the invention, color pigments, metallic pigments, extender pigments, ultraviolet absorbing agents can be further added to the amine-neutralized aqueous top coating composition, when required.

According to the coating method of the present invention, the substrate is sequentially coated with the amine-neutralized type aqueous intermediate coating composition and the amine-neutralized type aqueous top coating composition.

The substrate is not limited specifically and can be, for example, a metallic substrate such as an automotive exterior panel and the like, a plastic substrate and the like.

In the present invention, the amine-neutralized type aqueous intermediate coating composition can be directly applied to the substrate. Preferably, however, an under coating composition (primer) such as a cationic electrophoretic coating composition and the like is previously applied to the substrate and cured, and then the intermediate coating composition is applied to the obtained surface. The coating method is not limited specifically and various known methods can be employed. However, spray coating and electrostatic coating are preferred. The intermediate coating composition, when applied, preferably has a viscosity of 10 to 150 seconds as measured by Ford cup No. 4 at 20° C. The thickness of the intermediate coating is suitably 10 to 60μ (when cured).

In the invention, after or without crosslinking and curing the coating of the intermediate coating composition by heating, the top coating composition is applied to the surface coated with the intermediate coating composition. The intermediate coating composition is crosslinked and cured by heating usually at 100° to 180° C. for about 10 to 30 minutes.

The method of applying the top coating composition to the cured or uncured surface of intermediate coating is not limited specifically and various known methods can be widely employed. Among them, spray coating and electrostatic coating are preferred. The top coating composition, when applied, has a viscosity of 10 to 150 seconds as measured by Ford cup No. 4 at 20° C. The thickness of the top coating is suitably 20 to 100μ (when cured).

In the invention, the coating of the top coating composition is then crosslinked and cured by heating. When the intermediate coating is not previously cured, the top coating and intermediate coating are preferably cured at the same time. The top coating composition is crosslinked and cured by heating usually at 100° to 180° C. for about 10 to 30 minutes.

Further, in the invention, a clear coating composition may be applied to the surface of the top coating, when required.

The coating method of the present invention can improve the adhesion between layers of a multi-layer coating film formed from aqueous coating compositions (in particular, adhesion between intermediate coating and top coating) and chipping resistance of said coating film.

BEST MODE FOR CARRYING OUT THE INVENTION

Examples and Comparative Example are given below to illustrate the present invention in further detail.

PREPARATION EXAMPLE 1

(Preparation of amine-neutralized type aqueous intermediate coating composition)

The components shown in Table 1 were mixed in the proportions shown in the table (as weight of solid content). Water was added in a suitable amount to disperse the mixture in a viscosity of 30 seconds as measured by Ford cup No 4 at 20° C. giving an amine-neutralized type aqueous intermediate coating composition. Intermediate coating compositions A-1, A-2 and A-3 were used in Examples 1, 2 and 3, respectively, and intermediate coating composition A-4 was used in Comparative Example.

TABLE 1

| Intermediate coating composition | A-1 | A-2 | A-3 | A-4 |
|---|---|---|---|---|
| Component (A) | | | | |
| Amine-neutralized PE resin a | 65 | | | |
| Amine-neutralized PE resin b | | 75 | | 75 |
| Amine-neutralized PE resin c | | | 80 | |
| Component (B) | | | | |
| Melamine resin | 35 | 25 | 20 | 25 |
| Component (C) | | | | |
| Dimethylethanolamine salt of dodecylbenzenesulfonic acid | 2 | 2 | 2 | |
| Component (D) | | | | |
| Titanium white | 70 | 70 | 70 | 70 |

Particulars of the resins shown in Table 1 are as follows.

Amine-neutralized PE resin a: A resin prepared by neutralizing, with dimethylethanolamine, a polyester resin having a hydroxyl value of 85 KOH mg/g and an acid value of 40 KOH mg/g (number average molecular weight of 10000, prepared by reacting neopentyl glycol, trimethylol propane, adipic acid and phthalic anhydride and subjecting the reaction product to addition of trimellitic anhydride), Amine-neutralized PE resin b: A resin prepared by neutralizing, with dimethylethanolamine, a polyester resin having a hydroxyl value of 85 KOH mg/g, an acid value of 25 KOH mg/g (number average molecular weight of 10000, prepared by reacting neopentyl glycol, trimethylol propane, adipic acid and phthalic anhydride, and subjecting the reaction product to addition of trimellitic anhydride), Amine-neutralized PE resin c: A resin prepared by neutralizing, with dimethylethanolamine, a polyester resin having a hydroxyl value of 100 KOH mg/g and an acid value of 25 KOH mg/g (number average molecular weight of 12000, prepared by reacting neopentyl glycol, trimethylol propane, adipic acid and phthalic anhydride and subjecting the reaction product to addition of trimellitic anhydride).

Melamine resin: Trade name "Cymel 350", number average molecular weight of 450, product of Mitsui Cytec Industries.

PREPARATION EXAMPLE 2

(Preparation of amine-neutralized type aqueous top coating composition)

Seventy parts by weight of an acrylic resin (hydroxyl value of 60 KOH mg/g, acid value of 35 KOH mg/g, prepared using dimethylethanolamine as the neutralizing agent, number average molecular weight of 6000, component (D)), 30 parts by weight of butyletherified melamine (component (E)) and 60 parts by weight of titanium white pigment were mixed, and water was added in a suitable amount to disperse the mixture in a viscosity of 40 seconds as measured by Ford cup No. 4 at 20½C, giving an amine-neutralized type aqueous white top coating composition.

EXAMPLES 1 to 3 AND COMPARATIVE EXAMPLE 1

A cationic electrophoretic coating composition was applied to a steel panel and the coating was cured by heating. Each of the amine-neutralized type aqueous intermediate coating compositions obtained in Preparation Example 1 was applied to said panel by spraying to a thickness of 35 Ì, followed by heating at 140½C for 30 minutes. Then, the amine-neutralized type aqueous white top coating composition obtained in Preparation Example 2 was applied by spraying to a thickness of 45 Ì, followed by heating at 140½C for 30 minutes.

The properties of the multi-layer coating film thus obtained were determined by the following methods. Adhesion between layers: The coating film was crosswise cut with a cutter knife to the substrate to make 11 parallel cuts widthwise and lengthwise with spacing of about 1 mm to obtain 100 squares in 1 $cm^2$. Adhesive cellophane tape was applied over the coated surface and abruptly peeled off. The adhesion was evaluated according to the following criteria.

A: No peeling.

B: Slight peeling between intermediate coating and top coating.

C: Marked peeling between intermediate coating and top coating.

Chipping resistance: Using Q-G-R Gravelometer (trade name, product of Q Panel Corp.), No.7 graded gravel (0.1 kg) was forced out against the test panel at an air pressure of 4 $kg/cm^2$ and at a temperature of 20½C to give a impact to the coated panel mounted at an angle of 30½C. The coated surface was thereafter observed.

A: The top coating was partially and slightly marred by the impact.

B: The top coating was slightly peeled off by the impact. C: The top coating was markedly peeled off by the impact.

The results are shown in Table 2.

TABLE 2

| | Ex. 1 | Ex. 2 | Ex. 3 | Comp. Ex. 1 |
|---|---|---|---|---|
| Aqueous intermediate coating composition | A-1 | A-2 | A-3 | A-4 |
| Aqueous top coating composition | Preparation Example 2 | | | |
| Adhesion between layers | A | A | A | C |
| Chipping resistance | A | A | A | C |

We claim:

1. A coating method comprising sequentially applying an amine-neutralized aqueous intermediate coating composition and an amine-neutralized aqueous top coating composition, wherein a coating composition comprising (A) an amine-neutralized base resin having a hydroxyl value of 30 to 150 KOH mg/g and an acid value of 15 to 50 KOH mg/g, (B) an amino resin and (C) an organic sulfonic acid amine salt is used as the amine-neutralized aqueous intermediate coating composition.

2. A coating method according to claim 1 wherein the amine-neutralized base resin for use as component (A) is prepared by partially or completely neutralizing, with an amine, a polyester resin, an acrylic resin, an urethane resin or an alkyd resin each having a hydroxyl value of 60 to 120 KOH mg/g and an acid value of 20 to 40 KOH mg/g.

3. A coating method according to claim 1 wherein the amino resin for use as component (B) is a melamine resin, an urea resin, a benzoguanamine resin or a hydroxymethylated product of these resins.

4. A coating method according to claim 1 wherein the organic sulfonic acid amine salt for use as component (C) is a dimethylethanolamine salt of dodecylbenzenesulfonic acid.

5. A coating method according to any one of claims 1 to 4 wherein the proportions of components (A) and (B) are 50 to 90% of component (A) and 50 to 10% of component (B) based on the total weight of the two components, and the proportion of component (C) is 0.1 to 10% relative to the total weight of components (A) and (B).

6. A coating method according to any one of claims 1 to 4 wherein the proportions of components (A) and (B) are 60 to 80% of component (A) and 40 to 20% of component (B) based on the total weight of the two components, and the proportion of component (C) is 1 to 5% relative to the total weight of components (A) and (B).

* * * * *